US005269512A

United States Patent [19]

Crowson et al.

[11] Patent Number: 5,269,512

[45] Date of Patent: Dec. 14, 1993

[54] PITCHING AND BATTING CONDITIONING DEVICE

[75] Inventors: Joel L. Crowson, 4004 Lark St., Bossier City, La. 71112; Charles R. Posenauer, Phoenix, Ariz.

[73] Assignee: Joel L. Crowson, Bossier City, La.

[21] Appl. No.: 956,377

[22] Filed: Oct. 5, 1992

[51] Int. Cl.[5] ..... A63B 69/00

[52] U.S. Cl. ..... 273/26 R; 273/29 A; 273/191 B; 482/129

[58] Field of Search ..... 273/26 R, 191 B, 193 A; 482/102, 103, 129, 127, 125, 12, 20, 121, 124, 131, 133

[56] References Cited

U.S. PATENT DOCUMENTS

| | | | |
|---|---|---|---|
| 1,137,349 | 4/1915 | Patterson | 273/191 B |
| 3,604,712 | 9/1971 | Prior et al. | 273/186 |
| 3,804,420 | 4/1974 | Boyd | 273/191 B |
| 3,966,203 | 6/1976 | Bickford | 272/118 |
| 4,135,714 | 1/1979 | Hughes | 273/191 B |
| 4,229,002 | 10/1980 | Masters | 272/117 |
| 4,238,964 | 3/1982 | Walls | 273/26 R |
| 4,243,219 | 1/1981 | Price | 272/117 |
| 5,072,934 | 12/1991 | Blanes | 272/117 |
| 5,082,262 | 1/1992 | Sanchez | 273/26 R |

*Primary Examiner*—Theatrice Brown
*Attorney, Agent, or Firm*—John M. Harrison

[57] ABSTRACT

A pitching and batting conditioning device which is characterized in a first preferred embodiment by single and multiple drum conditioning devices having a drum spool for receiving a weight line attached to a weight and one or more drums of the same or different diameters for receiving a conditioning line or lines attached to a baseball bat or ball. Conditioning of the arm or arms and upper body is achieved by grasping the bat or ball and swinging the bat or simulating throwing the ball against the resistance of the weight. In another embodiment a multiple spring conditioning device also includes a conditioning line attached to a bat or ball and an adjustable feature for engaging springs of varying tension for application to the conditioning line. In a third embodiment a torsion spring is mounted in a housing with an adjustable torsional feature and includes a drum, upon which is wound a conditioning line attached to a bat or ball. Conditioning is achieved by varying amounts of tension applied to the torsion spring. A fourth embodiment features a dual pulley system for receiving a weight line and applying conditioning tension against a weight attached to the weight line.

4 Claims, 3 Drawing Sheets

PITCHING AND BATTING CONDITIONING DEVICE

BACKGROUND OF THE INVENTION

1. Field of the Invention

This invention relates to exercising equipment and more particularly, to pitching and batting conditioning devices which are designed to apply pressure or tension to the throwing arm or both arms and upper body and condition the throwing and batting muscles. In a first preferred embodiment of the invention the pitching and batting conditioning device is characterized by a single and multiple drum conditioning devices which are fitted with a spool, upon which is wound a weight line attached to a weight for applying a torque to the spool. One or more drums of varying diameter are attached to the spool and fitted with one or more conditioning lines attached to a bat or a ball for grasping by the user and throwing or batting against a selected amount of tension applied by the weight. In another preferred embodiment the pitching and batting conditioning device includes a multiple spring device fitted with multiple springs of varying tension that can be selectively rotatably integrated with a spool fitted with a conditioning line attached to a bat or ball. In a third embodiment the pitching and batting conditioning device includes a torsion spring mounted in a housing and attached to a spool, upon which is wound a conditioning line attached to a bat or ball. An adjusting feature is provided in the torsion spring for adjusting the tension in the torsion spring and swinging of the bat or simulated throwing of the ball operates against tension in the torsion spring to condition the batting and throwing muscles. In yet another preferred embodiment of the invention the pitching and batting conditioning device is characterized by a free weight and/or weight rack, dual pulley system for achieving the same result.

One of the problems which exists in batting and throwing or pitching in the games of softball or baseball is lack of sufficient muscle development to facilitate batting and pitching or throwing with great strength. Batting and pitching or throwing practice is normally limited to batting or throwing under simulated game conditions or in practice, without the addition of tension or weights to develop muscles which are used in the pitching or throwing and batting sequence. The pitching and batting conditioning device of this invention is designed to apply tension to a bat and ball for exercising and tensioning of the muscles used in throwing, pitching and batting a hard ball or soft ball.

Various types of conditioning and practice devices are known in the art for muscle toning and conditioning for various sports. For example, Arthur Prior, et al U.S. Pat. No. 3,604,712, dated Sep. 14, 1971, details a "Golf Club Practice Swing Guide", which includes a standard supporting rotary and translatory motion-producing mechanism at the upper end. A motion-transmitting mechanism is attached to and actuated by the motion producing mechanism and a clamp attached to the shaft of a club and to a club motion-control mechanism insures that the club is caused to swing with the head moving in an arc. If the club is not swung perfectly, resistance in the parts of the device is met, while with the proper swing little or no resistance is felt in the mechanism as the club swing is made. Richard A. Bickford U.S. Pat. No. 3,966,203, dated Jun. 29, 1976, details a device which includes a vertical guide member such as an open ended tube, a freefall weight which moves vertically along the guide member, a cord attached at one end to the weight and at the other end to a sock for attachment to the head of a golf club, a fairlead at the top of the guide member and a second fairlead located head high on the guide member. The cord passes through the fairleads and applies a pull on a golf club head equal to the weight, which can be changed to vary the degree of exercise obtained in the use of the device. A "Golf Swing Exercise Device" is detailed in David H. Masters U.S. Pat. No. 4,229,002, dated Oct. 21, 1980. The device is designed to be suspended on a door by means of a horizontal base, to which is secured door hooks. An elongated T-beam extending outwardly normal to the base is supported by pulleys and the T-beam is stabilized by beam stabilizers diagonally projecting from each side of the T-beam to a vertical beam. A rope extends through the pulleys and is secured to the T-beam and a golf grip and stub shaft is securely attached to one end of the rope, while the weight is attached to the opposite end of the rope. Grasping of the golf grip by an operator simulating a golf swing reciprocates the weight attached to the rope. Paul J. Price U.S. Pat. No. 4,243,219, dated Jan. 6, 1981, details a "Portable Lean-To Exercising Device" which includes a weight frame that may be leaned against the top of a door frame for support. The weight frame supports a weight sled or carriage, carrying a selected number of weights and the carriage travels along the weight frame and can be pulled from selected heights, depending upon the position of the pulley on the frame about a line which is attached to the carriage. A "Multiple Use Exercise Device" is detailed in Gary W. Blanes U.S. Pat. No. 5,072,934, dated Dec. 17, 1991. The Blanes device may be removably secured in a doorway and includes a telescopically-adjustable chinning bar which locks at any longitudinal increment, allowing it to be adjusted to fit different doorway widths. Weight resistance is provided by standard weight plates which are placed on a carrier that is coupled to a cable which runs through a first pulley attached to the chinning bar and optionally, through the second pulley and attaches to a handle lat bar or leg strap, depending upon which exercise is desired. With the cable running through the first pulley, an upward and lateral resistance is created that may be used for exercise which simulates golf, baseball, swimming, throwing and the like.

It is an object of this invention to provide new and improved pitching and batting conditioning devices which are designed to apply selected tension on a bat or ball to condition batting, pitching and throwing muscles in the games of baseball and softball.

Another object of the invention is to provide a pitching and batting conditioning device which is characterized by one or more drums for receiving a conditioning line attached to a ball or bat and a cooperating drum spool, upon which is wound a weight line secured to a weight of selected magnitude, such that the bat or ball is swung or thrown, respectively, against a selected tension in the conditioning line.

Yet another object of the invention is to provide a pitching and batting conditioning device which includes a housing containing one or more coil springs that may be selectively coupled to a drum spool containing a conditioning line attached to a bat or ball to facilitate simulating throwing of the ball and swinging of the bat against a desired tension applied by a selected number of the coil springs.

A still further object of the invention is to provide a pitching and batting conditioning device which includes a torsion spring attached to a drum, upon which is wound a conditioning line connected to a ball or bat, with an adjusting feature provided in the torsion spring for applying a selected amount of tension on the conditioning line during simulating throwing of the ball and swinging of the bat.

Another object of this invention is to provide a pitching and batting conditioning device which includes a pair of pulleys which receive a common weight and conditioning line, one end of which weight line is attached to one or more weights and the conditioning line to a bat or ball to facilitate simulated throwing of the ball and swinging of the bat against a selected tension in the conditioning line.

SUMMARY OF THE INVENTION

These and other objects of the invention are provided in pitching and batting conditioning devices which are designed to apply a selected degree of tension on a conditioning line attached to a ball or bat by operation of one or more weights or springs, in order to condition the batting, throwing and pitching muscles of a user by simulated throwing or pitching of the ball and swinging of the bat against the tension in the conditioning line.

BRIEF DESCRIPTION OF THE DRAWINGS

The invention will be better understood by reference to the accompanying drawings, wherein.

DESCRIPTION OF THE PREFERRED EMBODIMENTS

Figure 1:
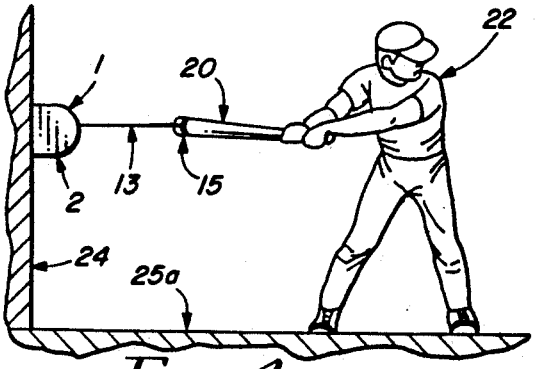
FIG. 1 is a side view of a single drum conditioning device having a conditioning line attached to a bat, with a batter in position to exert tension on the conditioning line.
Figure 2:
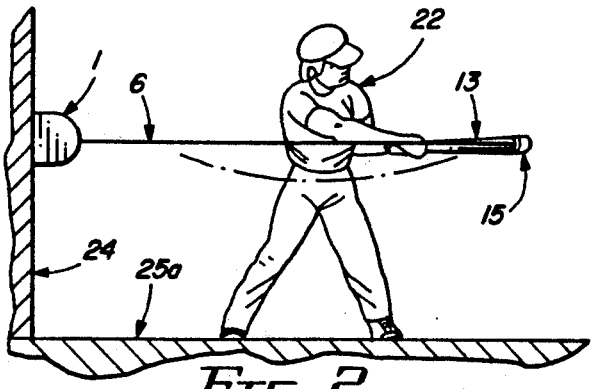
FIG. 2 is a side view of the single drum conditioning device illustrated in FIG. 1, wherein the batter has completed a swing against the tension in the tension line.
Figure 3:
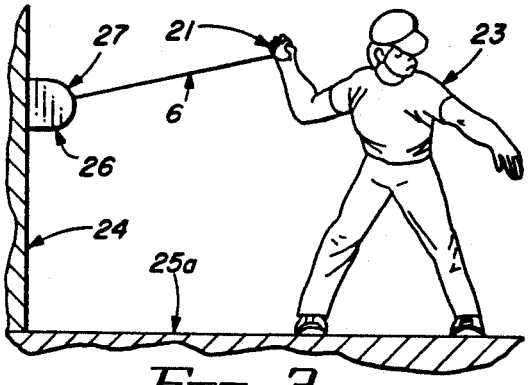
FIG. 3 is a side view of a multiple drum conditioning device fitted with a conditioning line, to the end of which is attached a ball, with a player in throwing or pitching stance for applying tension to the conditioning line.
Figure 4:
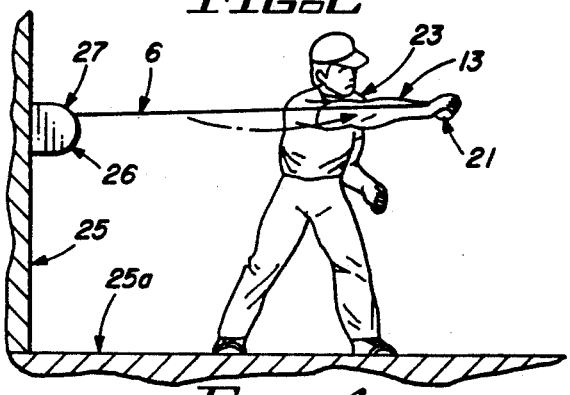
FIG. 4 is a side view of the multiple drum conditioning device illustrated in FIG. 3, with the player in a simulated throwing sequence wherein tension is applied to the conditioning line.
Figure 5:
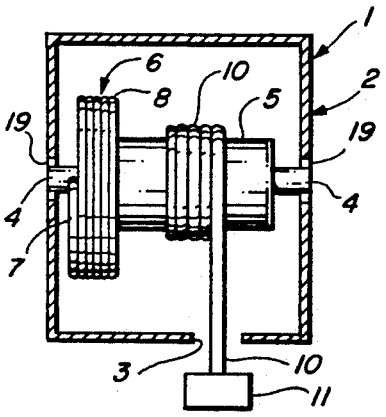
FIG. 5 is a front sectional view of the single drum conditioning device illustrated in FIGS. 1 and 2.

Referring initially to FIGS. 1, 2 and 5 of the drawings, in a first preferred embodiment of the invention the single drum conditioning device is generally illustrated by reference numeral 1. The single drum conditioning device 1 is characterized by a single drum housing 2, fitted with a single drum housing slot 3, from which is extended a flexible weight line 10. The weight line 10 is wound on a drum spool 9, fitted to a drum axle 4 mounted in each end of the single drum housing 2 by means of bearings 19, as illustrated in FIG. 5. A weight 11 is attached to the extending end of the weight line 10 and a single drum 5 is also mounted on the drum axle 4, such that rotation of the drum axle 4 also facilitates rotation of the single drum 5 and the drum spool 9 in concert. A flexible conditioning line 6 is wound on the single drum 5, with an anchor end 7 of the conditioning line 6 secured to the single drum 5, as also illustrated in FIG. 5. An attachment end 8 of the conditioning line 6 is attached to a ball or bat, as hereinafter further described.

Figure 6:
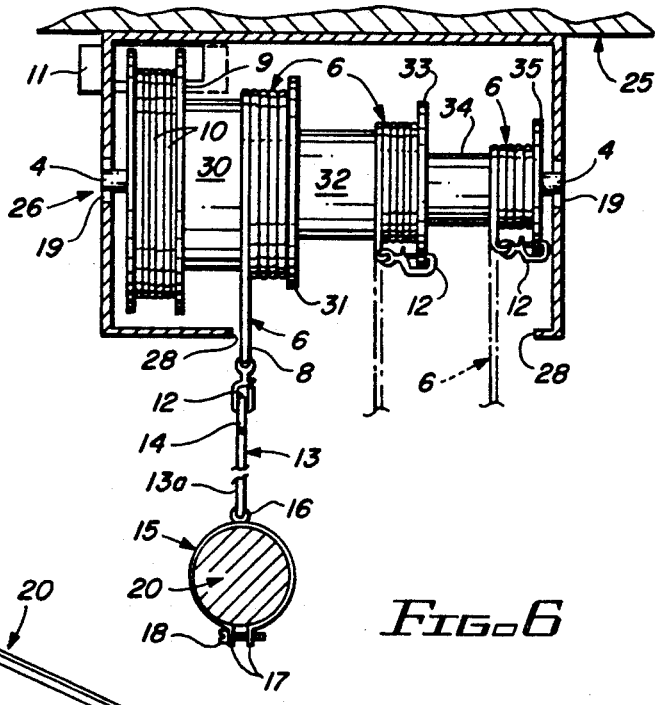
FIG. 6 is a front sectional view of the multiple drum conditioning device illustrated in FIGS. 3 and 4.
Figure 7:
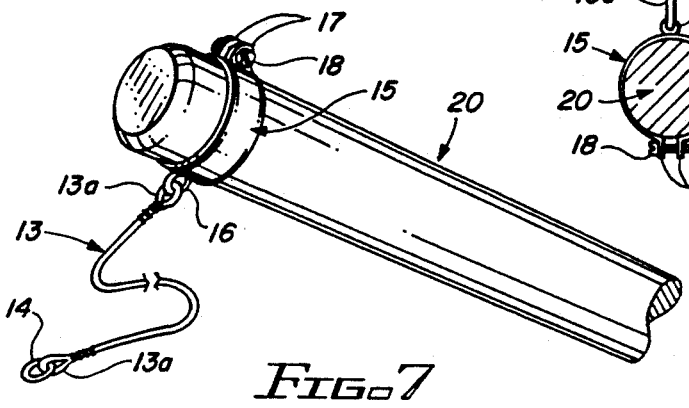
FIG. 7 is a perspective view, partially in section, of a typical connecting line and bracket which secures the conditioning line illustrated in FIGS. 3 and 4 to the bat.
Figure 8:
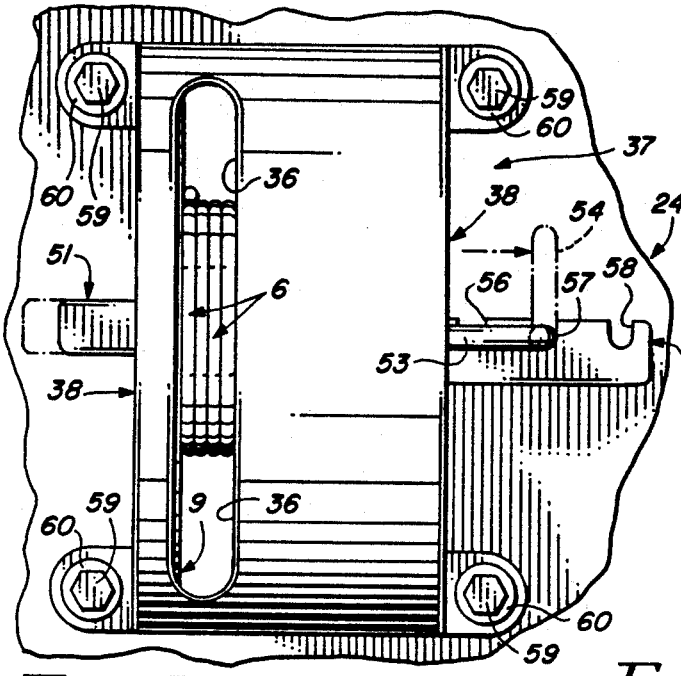
FIG. 8 is a front view of a multiple spring conditioning device of this invention.
Figure 9:
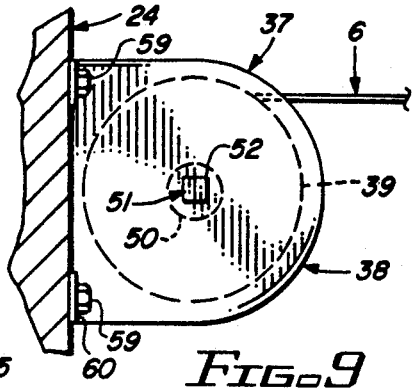
FIG. 9 is a left side view of the multiple spring conditioning device illustrated in FIG. 8.
Figure 10:
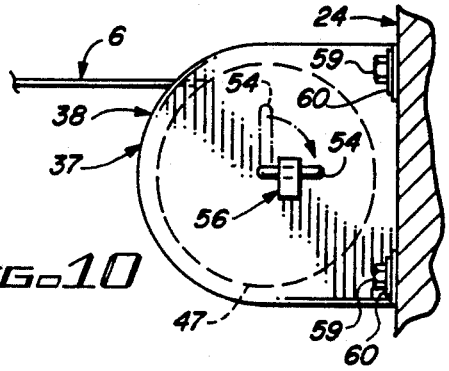
FIG. 10 is a right side view of the multiple spring conditioning device illustrated in FIG. 8.

Referring now to FIGS. 3, 4, 6 and 7 of the drawings, a multiple drum conditioning device is generally illustrated by reference numeral 26 and includes a multiple drum housing 27, adapted for mounting to a wall 24 of a structure in the same manner as the single drum conditioning device 1 illustrated in FIGS. 1, 2 and 5. The multiple drum housing 27 is also fitted with a multiple drum housing slot 28, from which is extended three conditioning lines 6, wound respectively on the large drum 30, fitted with a large drum plate 31, a middle drum 32, having a middle drum plate 33 and a small drum 34, provided with a small drum plate 35, as illustrated in FIG. 6. Likewise, a flexible weight line 10 is wound on a drum spool 9 attached to the large drum 30 and to a drum axle 4 which is journalled for rotation in a pair of bearings 19 provided in the sides of the multiple drum housing 27 and also mounts the middle drum 32 and small drum 34, as further illustrated in FIG. 6. Accordingly, rotation of the drum axle 4 with respect to the multiple drum housing 27 also facilitates rotation of the drum spool 9, large drum 30, middle drum 32 and small drum 34 in concert. Each of the flexible conditioning lines 6, wound on the respective large drum 30, middle drum 32 and small drum 34, is fitted with a line clip 12 for selective attachment to a corresponding connecting line ring 14, mounted on one end of a connecting line 13 by means of a line loop 13*a*. The opposite end of the connecting line 13 is also fitted with a line loop 13*a* for attachment to a bracket eye 16, secured to a connecting bracket 15 attached to the ball contact end of a bat 20, as further illustrated in FIGS. 6 and 7. The connecting bracket 15 may be attached to any desired bat 20 by loosening and tightening the flange bolt 18 which extends through the bracket flanges 17, as further illustrated in FIGS. 6 and 7. It will be appreciated by those skilled in the art that the connecting line 13 may also be attached to a ball 21 in any convenient fashion, for example, by means of a bolt (not illustrated) which is projected through the ball 21 or by other techniques well known to those skilled in the art. Accordingly, in both the single drum conditioning device 1 illustrated in FIGS. 1, 2 and 5 and the multiple drum conditioning device illustrated in FIGS. 3, 4, 6 and 7 a batter 22 or pitcher 23 may stand in the positions illustrated in FIGS. 1–4 and simulate batting, pitching or throwing practice against a desired tension applied by the weight 11 in each of the single drum conditioning device 1 and multiple drum conditioning device 26. Under circumstances where the bat 20 is attached to the conditioning line 6 which is wound on the large drum 30 in the multiple drum conditioning device 26 as illustrated in FIG. 6, the tension in the conditioning line 6 will be proportionally less than the tension applied to the other conditioning lines 6 wound on the middle drum 32 and small drum 34, respectively. Furthermore, as further illustrated in FIG. 6, the respective line clips 12 attached to the conditioning lines 6 which are wound on the middle drum 32 and small drum 34, respectively, may be attached to the respective middle drum plates 33 and small drum plate 35 by means of a plate opening or slot (not illustrated).

Figure 11:
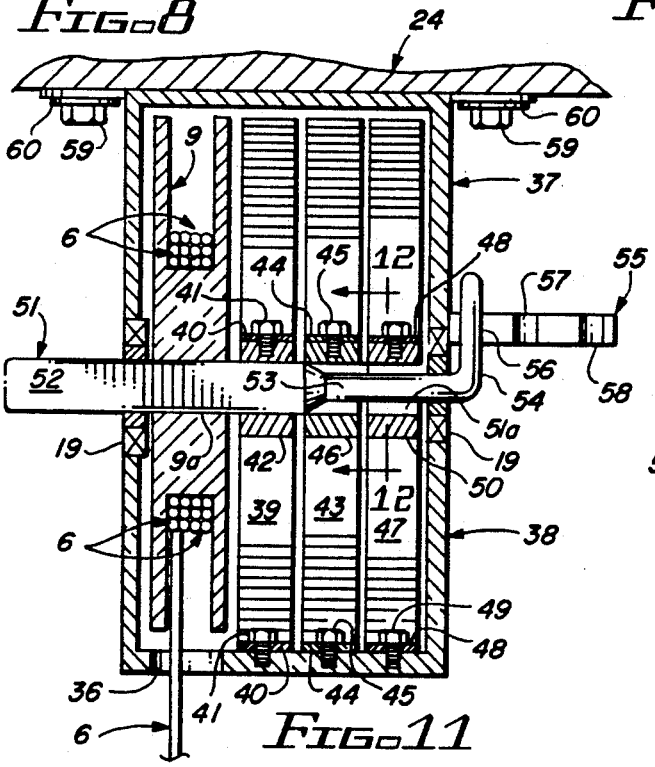
FIG. 11 is a top sectional view of the multiple spring conditioning device illustrated in FIGS. 8–10.
Figure 12:
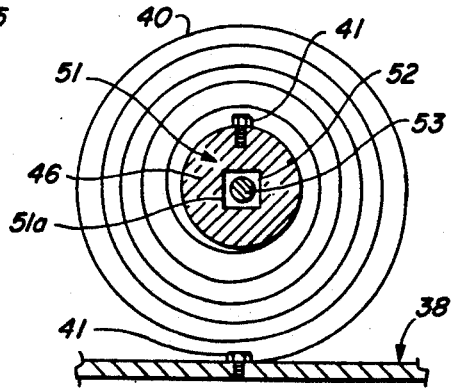
FIG. 12 is a side sectional view of the housing and a typical coil spring element used in the multiple spring conditioning device illustrated in FIGS. 8–11.

Referring now to FIGS. 8–12 of the drawings, in another preferred embodiment of the invention a multiple spring conditioning device is generally illustrated by reference numeral 37. The multiple spring conditioning device 37 includes a multiple spring housing 38, provided with a line slot 36, from which extends a conditioning line 6, which is wound on a drum spool 9, as illustrated in FIG. 11. The drum spool 9 is seated on an engaging segment 52 which is square in cross-section and forms a segment of a spring selection bar 51, the opposite end of which defines a round non-engaging segment 53 having an L-shaped adjusting arm 54, as further illustrated in FIG. 11. Both the non-engaging segment 53 and the engaging segment 52 of the spring selection bar 51 extend through a bar aperture 51*a*, defined by the aligned bores of a first spring mount tube 42, a second spring mount tube 46 and a third spring mount tube 50, mounted in the multiple spring housing 38, as further illustrated in FIG. 11. The drum spool 9 is provided with a spool opening 9*a* which is square in cross-section and receives the engaging segment 52 in slidable relationship, as hereinafter further described. The engaging segment 52 and non-engaging segment 53 of the spring selection bar 51 are journalled for rotation in the bearings 19, fitted in the multiple spring housing 38, as further illustrated in FIG. 11. A first spring housing 39, second spring housing 43 and third spring housing 47 are fitted in the multiple spring housing 38 and receive the first spring mount tube 42, second spring mount tube 46 and third spring mount tube 50, also as illustrated in FIG. 11. The first spring housing 39 encloses a first spring 40, one end of which is attached to the first spring mount tube 42 by means of a first spring bolt 41 and the other end of which is secured to the multiple spring housing 38 by another first spring bolt 41, as illustrated in FIGS. 11 and 12. Similarly, a second spring 44 is enclosed in the second spring housing 43 and one end of the second spring 44 is attached to the second spring mount tube 46 by means of a second spring bolt 45, while the opposite end of the second spring 44 is secured to the multiple spring housing 38 by another second spring bolt 45. In like manner, a third spring 48 is enclosed within the third spring housing 47 and one end of the third spring 48 is secured to the third spring mount tube 50 by means of a third spring bolt 49, while the opposite end of the third spring 48 is attached to the multiple spring housing 38 with another spring bolt 49. As further illustrated in FIGS. 8 and 11, an adjusting bar 55 is fixed to the multiple spring housing 38 and extends from the multiple spring housing 38 in close proximity to, and in transverse alignment with respect to, the adjusting arm 54 of the non-engaging segment 53 of the spring selection bar 51. A first spring slot 56, second spring slot 57 and third spring slot 58 are provided in spaced relationship in the extending portion of the adjusting bar 55 for selectively receiving the adjusting arm 54 and causing the engaging segment 52 of the spring selection bar 51 to extend through the bar registering apertures 51*a* of the aligned first spring mount tube 42, second spring mount tube 46 and third spring mount tube 50 and allow rotation of the drum spool 9 against the tension in either the first spring 40, second spring 44 or the third spring 48, as desired. Accordingly, referring again to FIG. 11, when the spring selection bar 51 is situated such that the engaging segment 52 is aligned with only the first spring housing 39 and the adjusting arm 54 is seated in the corresponding first spring slot 56 of the adjusting bar 55, unwinding of the conditioning line 6 responsive to batting or throwing as illustrated in FIGS. 1–4 of the drawings, tensions only the first spring 40. However, adjustment of the spring selection bar 51 into the position illustrated in FIG. 8 such that the adjusting arm 54 is seated in the second spring slot 57 and the engaging segment 52 of the spring selection bar 51 is aligned with both the first spring housing 39 and the second spring housing 43, applies the additional tension of the second spring 44 as the conditioning line 6 is unwound from the drum spool 9 and the drum spool 9 rotates with the spring selection bar 51. Additional tension can be applied by further adjusting the spring selection bar 51 and extending the engaging segment 52 into alignment with the third spring housing 47 to apply tension to the first spring 40, second spring 44 and third spring 48 in the manner described above. The multiple spring housing 38 may be bolted to a wall 24 at a desired height by means of housing mount bolts 59 and washers 60, as illustrated in FIGS. 8–11.

Figure 13:
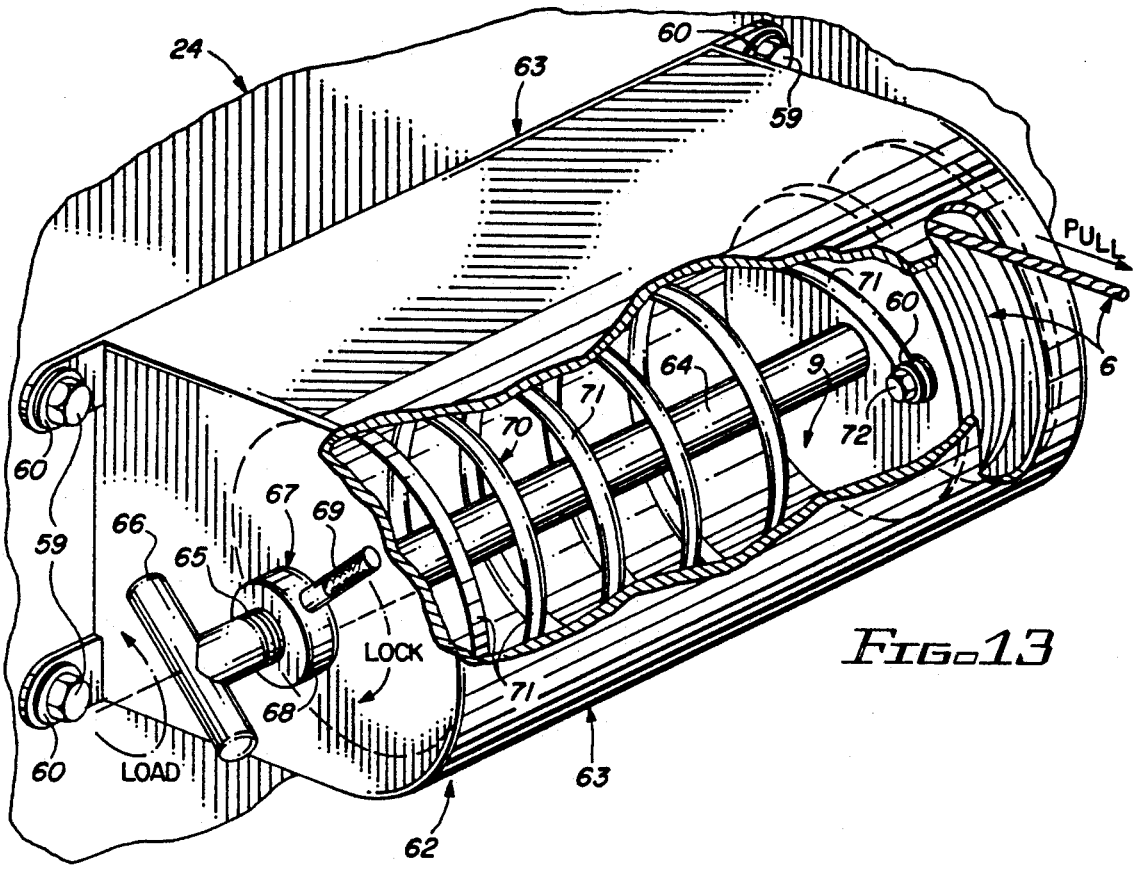
FIG. 13 is a perspective view, partially in section, of a torsion spring conditioning device of this invention.

A torsion spring conditioning device 62 is illustrated in FIG. 13 of the drawings and includes a torsion spring housing 63, which is mounted to the wall 24 by means of housing mount bolts 59 and washers 60 in the same manner as the multiple spring conditioning device 37 illustrated in FIGS. 8–12 and the multiple drum conditioning device 26 and single drum conditioning device 1, illustrated in FIGS. 1–6. A spring shaft 64 extends through the torsion spring housing 63 and is journalled for rotation in the spool end of the torsion spring housing 63 only. A conditioning line 6 is wound on a drum spool 9 mounted on the spring shaft 64, with one end of the spring coil 71 of a torsion spring 70 secured to the drum spool 9 by means of a coil mount bolt 72 and washer 60. The opposite end of the torsion spring 70 is attached to the torsion spring housing 63 by any suitable means. The spring shaft 64 extends through the torsion spring housing 63 and terminates in a T-bar 66. Furthermore, the spring shaft 64 is provided with shaft threads 65 between the T-bar 66 and the torsion spring housing 63 and the shaft threads 65 receive a shaft lock 67, which is characterized by a lock nut 68, fitted with an extending knurled nut arm 69. Accordingly, it will be appreciated that a selected amount of tension can be applied to the torsion spring 70 and the spring shaft 64 by rotating the spring shaft 64 in the clockwise direction as viewed from the T-bar 66 and this tension can be maintained in the spring coil 71 of the torsion spring 70 by manipulating the shaft lock 67 in position against the torsion spring housing 63. Unwinding of the conditioning line 6 from the drum spool 9 as the drum spool 9 rotates against the tension in the torsion spring 70 and spring shaft 64 creates a desired degree of tension in the conditioning line 6 against a bat or ball which is attached to the extending end of the conditioning line 6 in the same manner as that illustrated in FIGS. 1–4. In an alternative embodiment the spring shaft 54 may be journalled for rotation in both ends of the torsion spring housing without the T-bar 66 and shaft lock 67, with tension exerted on the conditioning line 6 applied only to the torsion spring 70.

Figure 14:
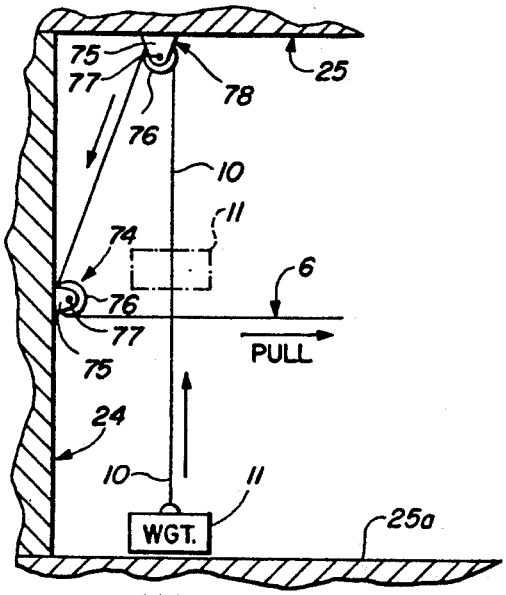
FIG. 14 is a side view of a typical wall pulley and ceiling pulley conditioning device.

Referring now to FIG. 14 of the drawings, in yet another preferred embodiment of the invention the pitching and batting condition device of this invention is characterized by a wall pulley 74, fitted with a pulley frame 75 mounted to the wall 24 and a pulley sheave 76 rotatably mounted on the pulley frame 75 by means of a pulley pin 77. Likewise, a ceiling pulley 78 of the same design is mounted by means of a pulley frame 75 to the ceiling 25. A weight line 10 extends vertically upwardly from a weight 11, around the pulley sheave 76 of the ceiling pulley 78, to the pulley sheave 76 of the wall pulley 74, horizontally where it is characterized as a conditioning line 6 and to a bat or ball as illustrated in FIGS. 1–4 of the drawings. Accordingly, tension is applied to the conditioning line 6 as the bat or ball is extended as illustrated in FIGS. 1–4, against the weight 11 which is lifted from the floor 25*a* during operation of the pitching and batting conditioning device.

Figure 15:
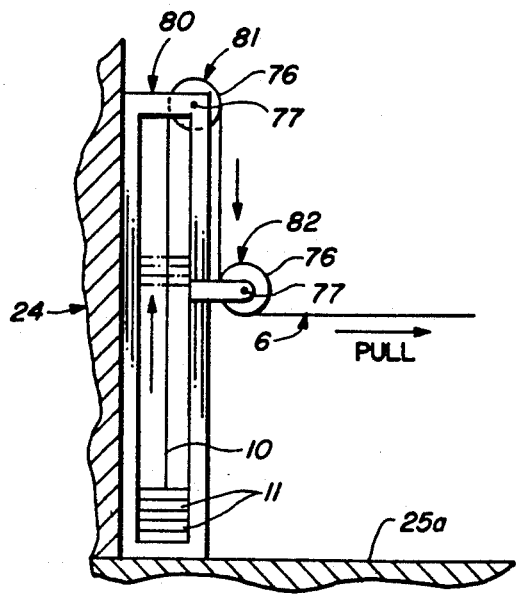
FIG. 15 is a side view of a weight rack conditioning device of this invention.

Referring now to FIG. 15 of the drawings in another preferred embodiment of the invention the pitching and batting conditioning device of this invention is characterized by a weight rack 80, which is provided with multiple weights 11 having a pin-operated weight selection system (not illustrated) as in conventional systems. A weight line 10 extends vertically from selective attachment to the weights 11 and projects around the pulley sheave 76 of a top rack pulley 81, which is designed in the same manner as the ceiling pulley 78 and wall pulley 74 illustrated in FIG. 14. The weight line 10 extends downwardly outside the weight rack 80, around the corresponding pulley sheave 76 in a middle rack pulley 82 and horizontally, for attachment as a conditioning line 6 to a bat or ball in the same manner as illustrated in FIGS. 1–4. Accordingly, swinging of the bat or projecting of the ball in a throwing or pitching manner as illustrated in FIGS. 1–4, applies tension to the conditioning line 6 by operation of a selected number of the weights 11.

It will be appreciated by those skilled in the art that the various pitching and batting conditioning devices of this invention are designed to apply tension to a conditioning line attached to a bat or ball and strengthen the pitching, throwing and batting muscles of a user. The devices are versatile and can be mounted in a small space in substantially any enclosure or even outside, as desired.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A pitching and batting conditioning device comprising a fixed housing; spring selection bar means slidably and rotatably disposed in said housing, said spring selection bar means having an engaging segment and a non-engaging segment; a drum positioned in said housing and carried by said engaging segment of said spring selection bar means; a conditioning line wound on said drum; at least one spring mount tube provided in said housing for selectively engaging said engaging segment of said spring selection bar means; and at least one coil spring positioned in said at least one spring mount tube, with one end of said coil spring attached to said spring mount tube and the opposite end of said coil spring attached to said housing, whereby conditioning tension is exerted on said conditioning line as said conditioning line is unwound from said drum responsive to slidable engagement of said engaging segment with said spring mount tube and tensioning of said coil spring.

2. The pitching and batting conditioning device of claim 1 wherein said at least one spring mount tube further comprises a plurality of spring mount tubes provided in said housing, said at least one coil spring further comprises a plurality of coil springs, each having one end mounted on said spring mount tubes, respectively, and the other ends of said coil springs attached to said housing and further comprising an adjustment bar fixedly carried by said housing and a plurality of slots provided in said adjustment bar in spaced relationship, whereby selective slidable extension of said spring selection bar means in said housing and seating of said non-engaging segment of said spring selection bar means in a selected one of said slots causes said engaging segment to selectively engage selected ones of said spring mount tubes and tension selected ones of said coil springs.

3. The pitching and batting conditioning device of claim 1 wherein said conditioning line is attached to a bat.

4. The pitching and batting conditioning device of claim 3 wherein said at least one spring mount tube further comprises a plurality of spring mount tubes provided in said housing, said at least one coil spring further comprises a plurality of coil springs, each having one end mounted on said spring mount tubes, respectively, and the other ends of said coil springs attached to said housing and further comprising an adjustment bar fixedly carried by said housing and a plurality of slots provided in said adjustment bar in spaced relationship, whereby selective slidable extension of said spring selection bar means in said housing and seating of said non-engaging segment of said spring selection bar means in a selected one of said slots causes said engaging segment to selectively engage selected ones of said spring mount tubes and tension selected ones of said coil springs.

* * * * *